US005183691A

United States Patent [19]

Hassell et al.

[11] Patent Number: 5,183,691

[45] Date of Patent: Feb. 2, 1993

[54] PAPER COATING HEAD, APPARATUS AND METHOD

[75] Inventors: Morgan V. Hassell; Frederick J. Stephens, both of St. Austell; Ernest J. Edwards, Kenilworth, all of England

[73] Assignee: ECC International Limited, United Kingdom

[21] Appl. No.: 431,459

[22] Filed: Nov. 3, 1989

[30] Foreign Application Priority Data

Nov. 4, 1988 [GB] United Kingdom ..... 8825908

[51] Int. Cl.[5] ..... B05D 3/12; B05D 5/00; B05C 3/18; B05C 3/20

[52] U.S. Cl. ..... 427/286; 427/288; 427/356; 118/409; 118/413

[58] Field of Search ..... 118/413, 409, 419; 427/286, 356, 358, 434.3, 288

[56] References Cited

U.S. PATENT DOCUMENTS 3,416,943 12/1968 Clark et al. ..... 118/413 X
4,143,187 3/1979 Pilgrim et al. ..... 427/358
4,250,211 2/1981 Damrau et al. ..... 427/356

*Primary Examiner*—Evan Lawrence
*Attorney, Agent, or Firm*—Klauber & Jackson

[57] ABSTRACT

There is disclosed a head for use in an apparatus for coating a sheet member which comprises a first body portion, securable at a predetermined spacing from the surface to be coated, a coating blade securable to the first body portion and projecting towards said surface to be coated and a second body portion which is resiliently mounted with respect to the first body portion and which, in use, defines with the sheet material with which it is in contact and with the blade, a coating pool which is fed by a coating reservoir and from which the coating composition is applied to the sheet material. Also disclosed is an apparatus including the head and a method of coating a sheet material with the head.

12 Claims, 4 Drawing Sheets

PAPER COATING HEAD, APPARATUS AND METHOD

This invention relates to a coating head for a coating apparatus, to a coating apparatus including a coating head and to a method of coating sheet material such as paper and other light fibrous materials. More particularly, but not exclusively, the present invention relates to a paper coating apparatus of the variety in which the coating head is movable, in operation, parallel to the axis of rotation of a backing roll supporting the sheet material, whereby a helical strip of sheet material may be coated.

Our British Patent No. 1032536 discloses an apparatus for coating sheet material, the apparatus comprising a rotatable backing roll upon which a sample of sheet material, such as paper, may be mounted to form a cylinder, a coating head which includes a blade and a reservoir for reception of a coating composition, and means for enabling the coating head to be moved in operation parallel to the axis of rotation of the backing roll and in contact with the sheet material mounted thereon whilst the backing roll is rotated, whereby a helical strip of sheet material may be coated. This apparatus, whilst generally excellent for use in the analysis of the rheological properties of coating compositions under conditions corresponding to the conditions in a pilot paper-coating apparatus or a full scale paper-coating apparatus, suffers from the disadvantage that, at exceptionally high coating velocities, i.e. when the relative velocity of the sheet material and the coating head is above about 1000 m/min, friction between the head and the sheet material is sufficient to cause burning of the sheet material. Consequently, the coating conditions of a pilot or full scale paper-coating apparatus cannot be precisely mimicked and the apparatus becomes less reliable in analysing the rheological properties of paper-coating compositions under exceptionally rigorous conditions. In the apparatus disclosed in our British Patent No. 1032536, the edges of the coating head which are to contact the sheet member on the drum are fitted with felt-edged seals. More recently, a friction reducing material such as polytetrafluoroethylene (PTFE) has been employed in place of the felt. However, the problem of friction burning still persists and, when PTFE is used, may be exaggerated once burning commences since the burning leads to destruction of the PTFE and consequent leaking of the coating composition from the reservoir.

In accordance with a first aspect of the present invention, there is provided a head for use in an apparatus for coating a sheet member which comprises a first body portion, securable at a predetermined spacing from the surface to be coated, a coating blade securable to the first body portion and projecting towards said surface to be coated and a second body portion which is resiliently mounted with respect to the first body portion and which, in use, defines with the sheet material with which it is in contact and with the blade, a coating reservoir from which the coating composition is applied to the sheet material. We have found that friction burning at high paper coating velocities may be reduced significantly, and even eliminated entirely, by providing such a coating head in which the fastening of the coating blade relative to a surface to be coated is independent of the sealing of the coating head against the surface to be coated.

According to a second aspect of the present invention there is provided a coating apparatus for coating the surface of a sheet material, the apparatus comprising means for moving a sheet material relatively to a coating head and in contact therewith, said coating head comprising a first body portion, securable at a predetermined spacing from the surface to be coated, a coating blade securable to the first body portion and projecting towards said surface to be coated and a second body portion resiliently mounted with respect to the first body portion and, in use, defining with the sheet material with which it is in contact and with the blade, a coating reservoir from which the coating composition is applied to the sheet material.

According to a third aspect of the invention there is provided an apparatus for coating sheet material, the apparatus comprising a rotatable backing roll upon which a sample of sheet material may be mounted to form a cylinder, a coating head including a blade and a reservoir for reception of a coating composition, and means for enabling the coating head to be moved in operation parallel to the axis of rotation of the backing roll and in contact with the sheet material mounted thereon whilst the backing roll is rotated, whereby a helical strip of sheet material may be coated, wherein the coating head comprises a first body portion, securable at a predetermined spacing from the surface to be coated, a coating blade securable to the first body portion and projecting towards said surface to be coated and a second body portion resiliently mounted with respect to the first body portion and, in use, defining with the sheet material with which it is in contact and with the blade, the coating reservoir from which the coating composition is applied to the sheet material.

According to a fourth aspect of the present invention there is provided a method of coating a sheet material, the method comprising rotating the sheet material in the form of a cylinder about the axis of the cylinder and applying a coating to the sheet material by a coating head loaded with coating composition, the head being moved parallel to the axis of the cylinder while the latter is rotated, thereby applying the coating composition to a helical strip portion of the cylinder of sheet material, said coating head comprising a first body portion, securable at a predetermined spacing from the surface to be coated, a coating blade securable to the first body portion and projecting towards said surface to be coated and a second body portion resiliently mounted with respect to the first body portion and, in use, defining with the sheet material with which it is in contact and with the blade, the coating reservoir from which the coating composition is applied to the sheet material.

Using the coating head of the present invention, the pressure applied by the coating head to the coating surface is determined to be below the pressure at which frictional forces cause burning. The independent suspension of the second body part of the coating head means that the seal pressure can be adjusted without affecting the pressure of the blade against the surface to be coated.

According to another aspect of the present invention there is provided a coating head for a paper-coating apparatus in which a sheet material to be coated moves relatively to the head and in contact therewith, the head defining, with the sheet material with which it is in contact, a coating reservoir for reception of a coating composition, wherein surfaces of the coating head which are in contact with the surface to be coated are made of a highly heat-conductive material. Using such a coating head, frictional heat generated at the contact surface of the head and the surface to be coated may be rapidly dissipated, thereby avoiding frictional burning of the sheet material.

Preferably, the surface of the coating head in contact with the surface to be coated is a highly polished metal surface, preferably stainless steel.

The coating head used in accordance with any one of the first to fourth aspects of this invention may be a coating head as described in the immediately preceding paragraph, i.e. one in which the surface of the coating head in contact with the sheet material to be coated is of a highly heat conductive material, preferably a highly polished stainless steel.

The present invention enables the pressure on the blade to be increased without increasing the pressure on the paper and, therefore, the seal pressure. Using the apparatus of the present invention, the paper tends to absorb the forces exerted by the surface of the coating head by compressing and provides the enhanced seal. In this respect, it is to be noted that even the hardest of papers will compress by up to 10% of their thickness, perhaps of the order of 8 to 10 microns. As the paper compresses, surface irregularities tend to be "ironed out" thus giving an improved seal.

For a better understanding of the present invention and to show how the same may be carried into effect, reference will now be made, by way of example, to the accompanying drawings in which.

Figure 1:
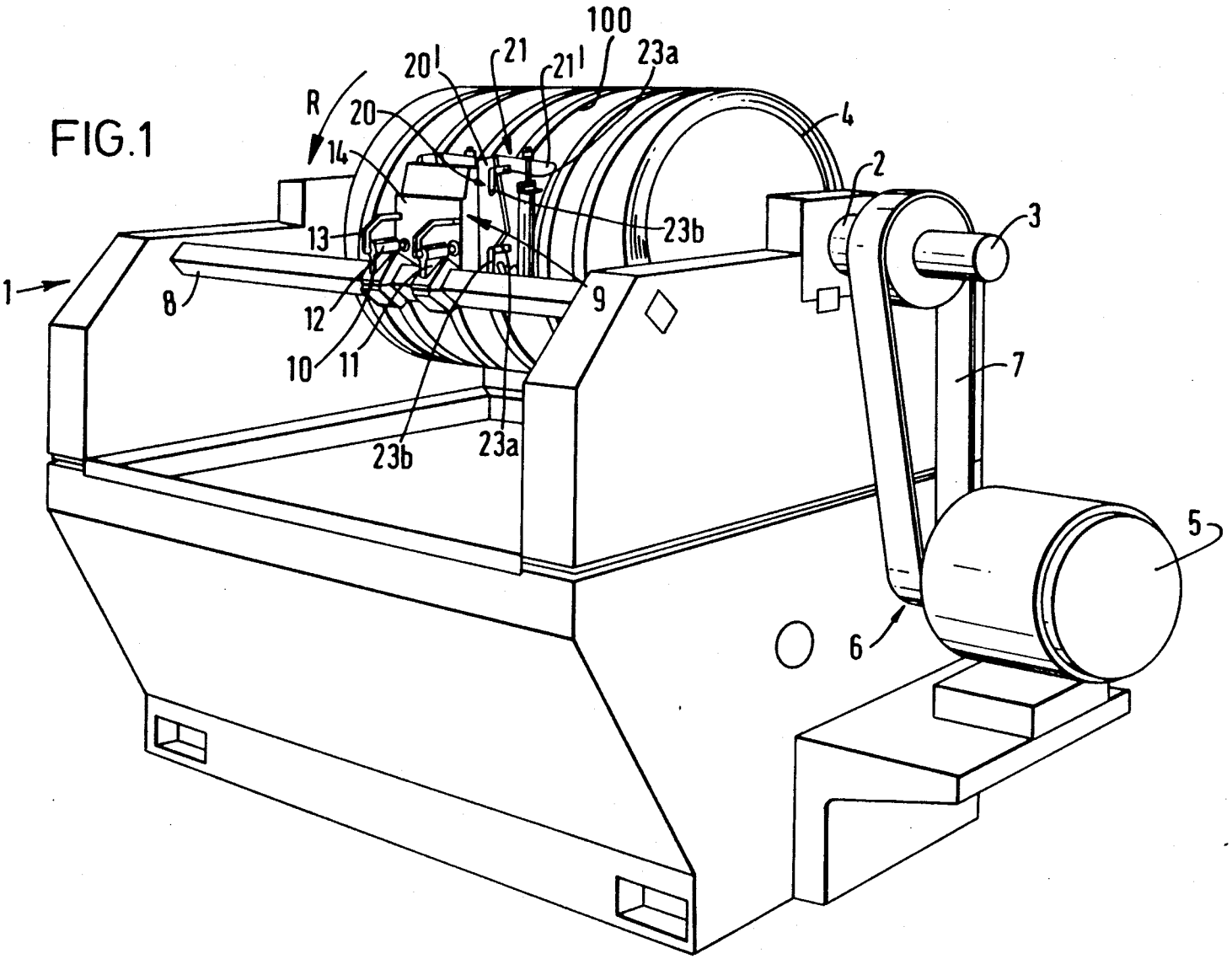
FIG. 1 is a general perspective view of an apparatus for coating sheet material.

The apparatus shown in FIG. 1 comprises a frame 1 on which are mounted two aligned bearing blocks 2. An axle 3 for a rubber-backing roll 4 is mounted for rotation in the bearing blocks 2. The backing roll 4 may be driven in the direction indicated by arrow R by an electric motor 5 through variable speed gearing 6, pulleys and a belt 7. A diamond-shaped carriageway or cross beam 8 is mounted on the frame 1 so as to extend parallel to the horizontal axis of the axle 3 and at a level below such axis.

Figure 2:
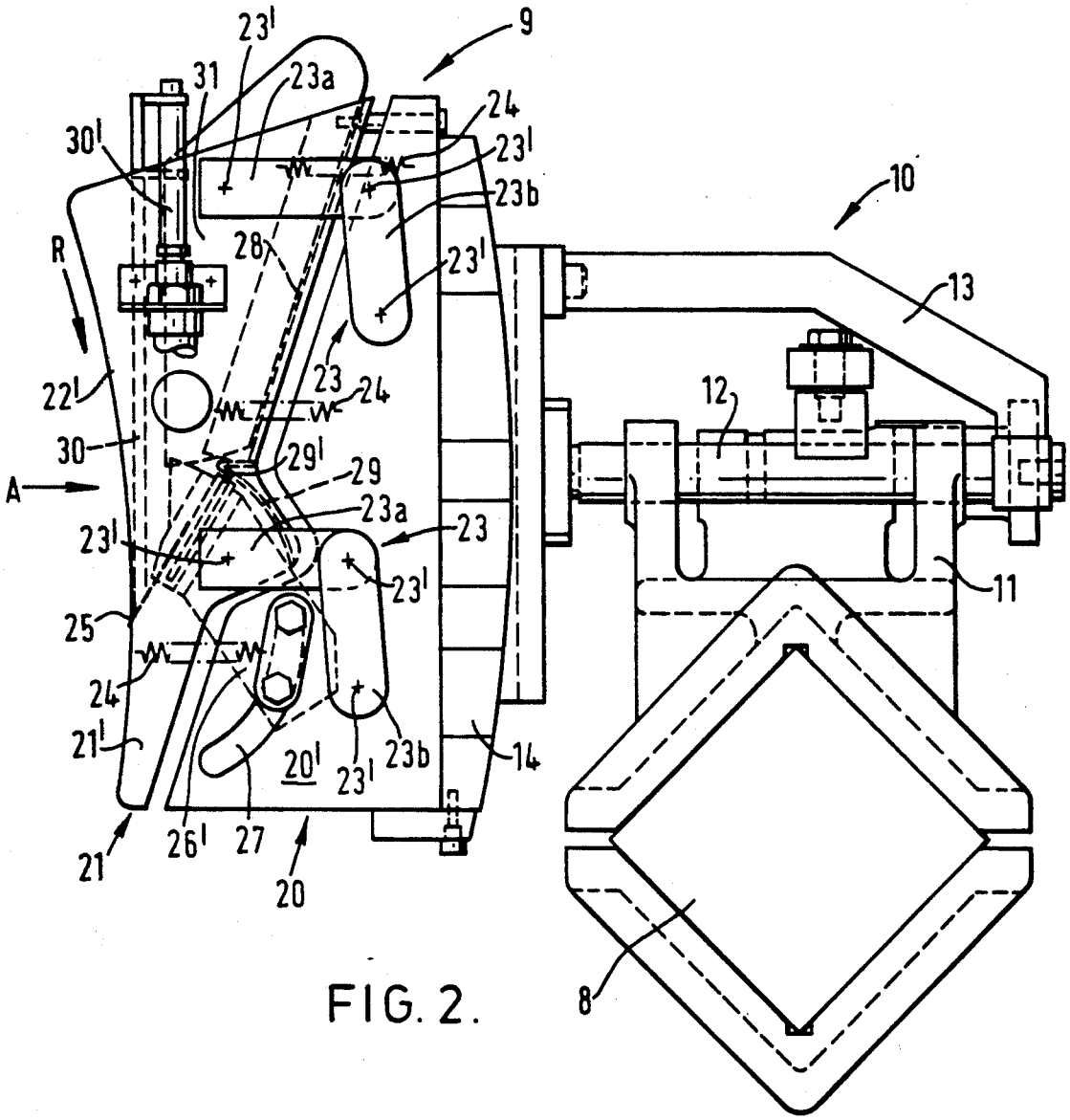
FIG. 2 is a side view of a coating head in accordance with the present invention fixed to the cross beam of the apparatus shown in FIG. 1.
Figure 4:
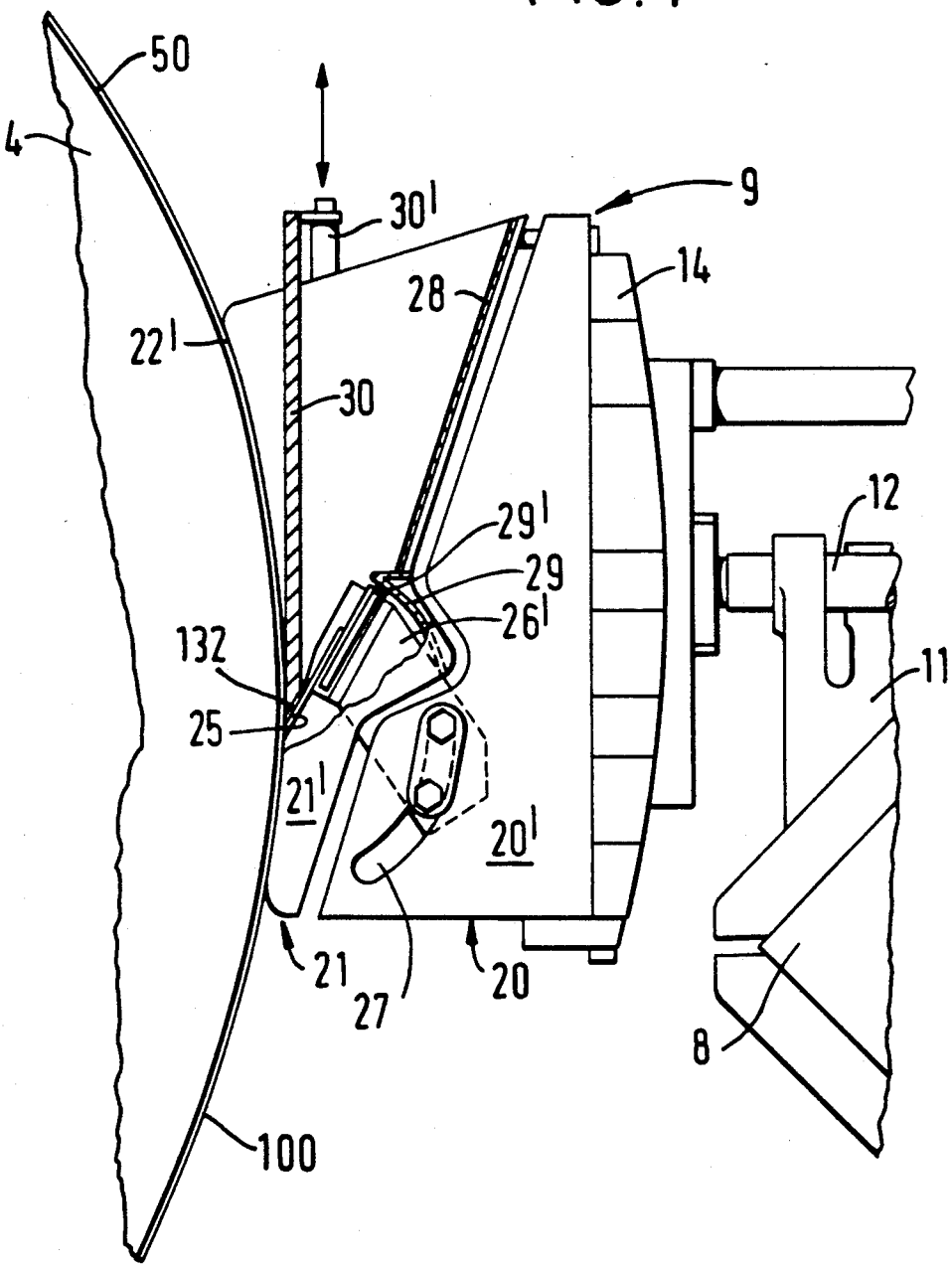
FIG. 4 is a perspective side view of a coating head in accordance with the present invention.

The coating head, genera designated by the reference numeral 9 in FIGS. 2 and 4 is movably mounted on the cross beam 8 (also see FIG. 1). The coating head 9 is movable along the cross beam 8 with the aid of a hydraulic cylinder and ram (not shown) or by way of a toothed belt (not shown). As shown in FIG. 2, the coating head 9 is mounted on the cross beam 8 via a support arrangement 10. The support arrangement 10 comprises a yoke 11, two actuating rods 12 (only one shown), two anti-twist rods 13 (only one shown) and a support plate 14.

Figure 3:
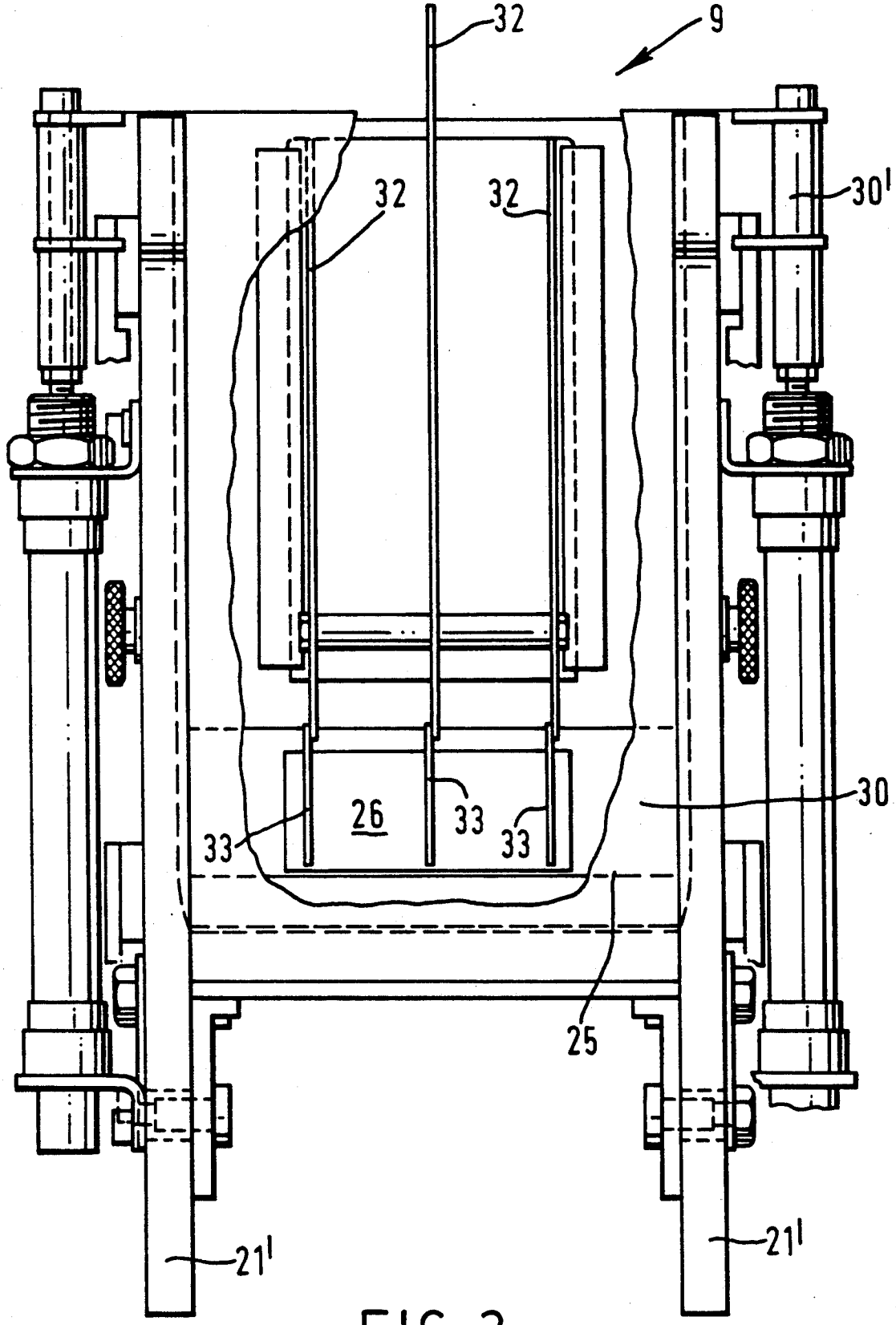
FIG. 3 is a view in the direction A of FIG. 2.

The coating head shown in FIGS. 2 and 3 comprises a first body portion 20 and a second body portion 21. Each of the first and second body portions comprises two stainless steel side pieces 20', 21'. Only the side pieces 21' of the second body portion may be seen in FIG. 3. The front edges 22' of the side pieces 211 are curved to match as precisely as possible the curvature of the drum 4 (see FIG. 1). Moreover, the surfaces of the side pieces 22 to contact the paper on the drum are highly polished to reduce friction. The two body portions 20 and 21 of the head are connected by four pivoting members 23 (only two shown) each of which comprises two parts 23*a*, 23*b*, which pivot about pivot points 23'. In addition, springs 24 between the two body portions 20, 21 are provided. A blade 25 is supported in a blade carrier 26 (see FIG. 3) at a lower region of the second body portion 21. The blade carrier 26 is mounted on plates 26' guided in arcuate grooves 27 in each side piece of the first body portion 20 in which the blade carrier 26 may slide, thereby controlling the angle of the blade 25. The second body portion 21 includes a rear wall 28 having a section with an arcuate surface 29. Against this arcuate surface 29, the blade carrier 26 may slide. The blade carrier 26 is sealed against surface 29 by a seal 29' of rubber, or other compressible material. At the front of the second body portion 21 is provided a shutter arrangement comprising a shutter 30 hydraulically openable by actuators 30' (also see FIG. 3).

The shutter 30 and rear wall 28 define a coating composition storage reservoir 31. As will be seen more clearly in FIG. 3, the coating composition storage reservoir 31 is subdivided by longitudinal baffles 32. Baffles 33 are also provided, in the lower region of the coating composition storage reservoir 31 close to the blade 25. These baffles reduce the tendency of the coating composition to surge as the head 9 moves translationally on the carriageway 8.

Operation of the coating head will now be described in relation to FIGS. 2 and 3. The coating head 9 is brought into contact with the surface 50 of a sheet member, for example, paper, wrapped around the drum 4 (see FIG. 1) by actuating the rod 12 to move to the left in FIG. 2. Movement of the coating head 9 to the left (i.e. toward the drum 4—see FIG. 1) will take place when a coating cycle is desired and will correspond to the moment at which the coating head 9 is caused to move translationally along the carriageway 8 (see FIG. 1). The rod 12 is moved a predetermined distance to the left (as shown) in order to urge the first body part 20 toward the surface to be coated, thereby also urging the blade support 26 and the blade 25 toward the surface 50 to be coated. Accordingly, it will be seen that the pressure on the blade is controllable by the force with which the rod 12 is urged toward the surface to be coated. However, the second body portion 21 is resiliently mounted on the first body portion 20 by the springs 24. The pivoting arms 23 secure the first body portion 20 and second body portion 21, thereby permitting the second body portion 21 to "float" on the first body portion. The pivot arms 23 pivot about the points 23'. As long as a gap is maintained between the first and second body portions 20, 21, the seal pressure (i.e. the pressure exerted by the second body portion on the surface 50 to be coated, will remain constant, and be determined by the spring constant of the springs 24 employed.

In operation, a coating composition is introduced into the coating composition storage reservoir 31 and, when a coating cycle is desired, the coating head 9 is urged toward, and into contact with, a sheet member supported on the drum 4 (FIG. 1) which typically is rotatable at a rate to give a surface velocity in the range of from 100 to 1200 m/minute. Simultaneously, the coating head 9 is caused to move translationally along the carriageway 8 and the shutter 30 is opened by actuators 30' a sufficient amount to permit the coating composition to flow out of the coating chamber 31 and be applied to the surface 50 of the paper on the drum 4 as a helical coating 100 by the blade 25, the blade 25 and the surface 50 of the paper defining a pool 132 of coating material which is fed by reservoir 31. At the end of its travel along the carriageway 8, the shutter 30 is closed and the front surface 22' of the coating head is withdrawn from the surface 50 of the paper on the drum 4 and drum 4 is permitted to slow down, whilst the coating composition on the paper is dried. The paper on the drum may then be removed and tested.

We claim:

1. A head for use in an apparatus for coating a sheet member which comprises a first body portion, securable at a predetermined spacing from the surface to be coated, a coating blade securable to the first body portion, and projecting towards said surface to be coated and a second body portion which is resiliently mounted with respect to the first body portion; and which contains a shutter such that in use, said second body portion and shutter define a coating composition reservoir, said second body portion in use defining with the sheet material with which it is in contact and with the blade, a coating pool which is fed by said coating composition reservoir and from which the coating composition is applied to the sheet material.

2. A coating apparatus for coating the surface of a sheet material, the apparatus comprising means for moving a sheet material relatively to a coating head and in contact therewith, said coating head comprising a first body portion, securable at a predetermined spacing from the surface to be coated, a coating blade securable to the first body portion and projecting towards said surface to be coated and a second body portion resiliently mounted with respect to the first body portion and, in use, defining with the sheet material with which it is in contact and with the blade, a coating pool from which the coating composition is applied to the sheet material; and reservoir means for feeding said coating composition to said coating pool.

3. An apparatus for coating sheet material, the apparatus comprising a rotatable backing roll upon which a sample of sheet material may be mounted to form a cylinder, a coating head including a blade, and a reservoir for reception of a coating composition, and means for enabling the coating head to be moved in operation parallel to the axis of rotation of the backing roll and in contact with the sheet material mounted thereon whilst the backing roll is rotated, whereby a helical strip of sheet material may be coated, wherein the coating head comprises a first body portion, securable at a predetermined spacing from the surface to be coated, a coating blade securable to the first body portion and projecting towards said surface to be coated and a second body portion resiliently mounted with respect to the first body portion and, in use, defining with the sheet material with which it is in contact and with the blade, a coating pool which is fed by said reservoir and from which the coating composition is applied to the sheet.

4. A method of coating a sheet material, the method comprising rotating the sheet material in the form of a cylinder about the axis of the cylinder and applying a coating to the sheet material by a coating head having a reservoir loaded with coating composition, the head being moved parallel to the axis of the cylinder while the latter is rotated, thereby applying the coating composition to a helical strip portion of the cylinder of sheet material, said coating head comprising a first body portion, securable at a predetermined spacing from the surface to be coated, a coating blade securable to the first body portion and projecting towards said surface to be coated and a second body portion resiliently mounted with respect to the first body portion and, in use, defining with the sheet material with which it is in contact and with the blade, a coating pool which is fed by said reservoir and from which the coating composition is applied to the sheet material.

5. A head according to claim 1, wherein the surface of the coating head which, in use, is in contact with the sheet material to be coated is of a highly heat conductive material.

6. A head according to claim 5, wherein the highly heat conductive material is a highly polished stainless steel.

7. A coating apparatus according to claim 2, wherein the surface of the coating head which, in use, is in contact with the sheet material to be coated is of a highly heat conductive material.

8. A coating apparatus according to claim 7, wherein the highly heat conductive material is a highly polished stainless steel.

9. An apparatus according to claim 3, wherein the surface of the coating head which, in use, is in contact with the sheet material to be coated is of a highly heat conductive material.

10. An apparatus according to claim 9, wherein the highly heat conductive material is a highly polished stainless steel.

11. A method according to claim 4, wherein the surface of the coating head which, in use, is in contact with the sheet material to be coated is of a highly head conductive material.

12. A method according to claim 11, wherein the highly heat conductive material is a highly polished stainless steel.

* * * * *